United States Patent [19]

Sjolie

[11] 4,110,854

[45] Sep. 5, 1978

[54] MODULAR BASE FOR WATERBED OR THE LIKE

[76] Inventor: Robert H. Sjolie, 346 Charcot Ave., San Jose, Calif. 95131

[21] Appl. No.: 838,818

[22] Filed: Oct. 3, 1977

[51] Int. Cl.[2] ..... A47C 7/00; A47G 9/00

[52] U.S. Cl. ..... 5/2 R; 5/370; 5/58

[58] Field of Search ..... 5/2 R, 58, 369–371; 312/108, 111

[56] References Cited

U.S. PATENT DOCUMENTS

| | | | |
|---|---|---|---|
| 2,787,007 | 4/1957 | Erdkamp | 5/2 R |
| 3,732,583 | 5/1973 | Jones | 5/2 R |
| 3,811,728 | 5/1974 | Redemske | 5/2 R |
| 3,996,633 | 12/1976 | Burke | 5/370 |
| 4,057,862 | 11/1977 | LaBianco | 5/370 |

*Primary Examiner*—Casmir A. Nunberg
*Attorney, Agent, or Firm*—Robert G. Slick

[57] ABSTRACT

A modular base for a waterbed or the like is provided wherein the base is formed of a plurality of discreet segments, preferably six, which may serve not only to support the waterbed but also for storage. In accordance with one embodiment of the invention, the modular elements are made of thin plywood which are set into a dadoed frame, greatly decreasing the cost and weight of the unit.

5 Claims, 6 Drawing Figures

MODULAR BASE FOR WATERBED OR THE LIKE

SUMMARY OF THE INVENTION

Supports for waterbeds have traditionally been made as a single unit and such units are extremely heavy and awkward. It is difficult to move them, particularly if they have to be moved up stairways and the like. Also, because of the large size, they require the services of several people and frequently get broken in shipment.

In accordance with the present invention, a base or support for a waterbed is provided which is made of a number of modular units. Preferably six units are employed and the supprot members can also be employed as storage units.

In accordance with the present invention, the modular units, preferably six in number, can be made in different forms. For instance, they can be made with doors or drawers or can be made plain. The units can be interchanged since some customers may prefer all drawers or all doors, and thus this can supply the desired units for the customers preferance.

A further advantage of the present invention is that the modular units are formed of frame members having dadoes with plywood panels in the dadoes. It has been found that even the heaviest waterbed can be supported in this manner utilizing only quarter-inch plywood. Accordingly, the modular units of the present invention are extremely light in weight and easy to move.

Thus, in accordance with the present invention, the modular units permit one man to install a waterbed where previously two or more people were necessary to move the heavy base which is required.

Various other features and advantages of the invention will be brought out in the balance of the specification.

DESCRIPTION OF THE PREFERRED EMBODIMENTS

Figure 1:
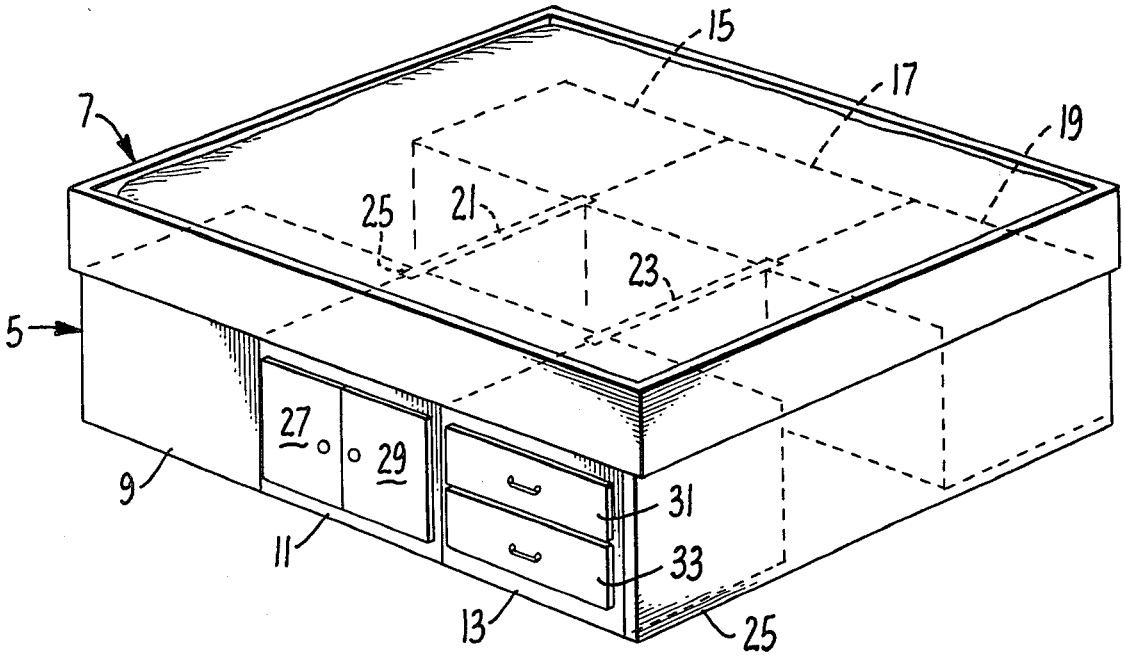
FIG. 1 is a perspective view of a waterbed embodying the support modules of the present invention.
Figure 2:
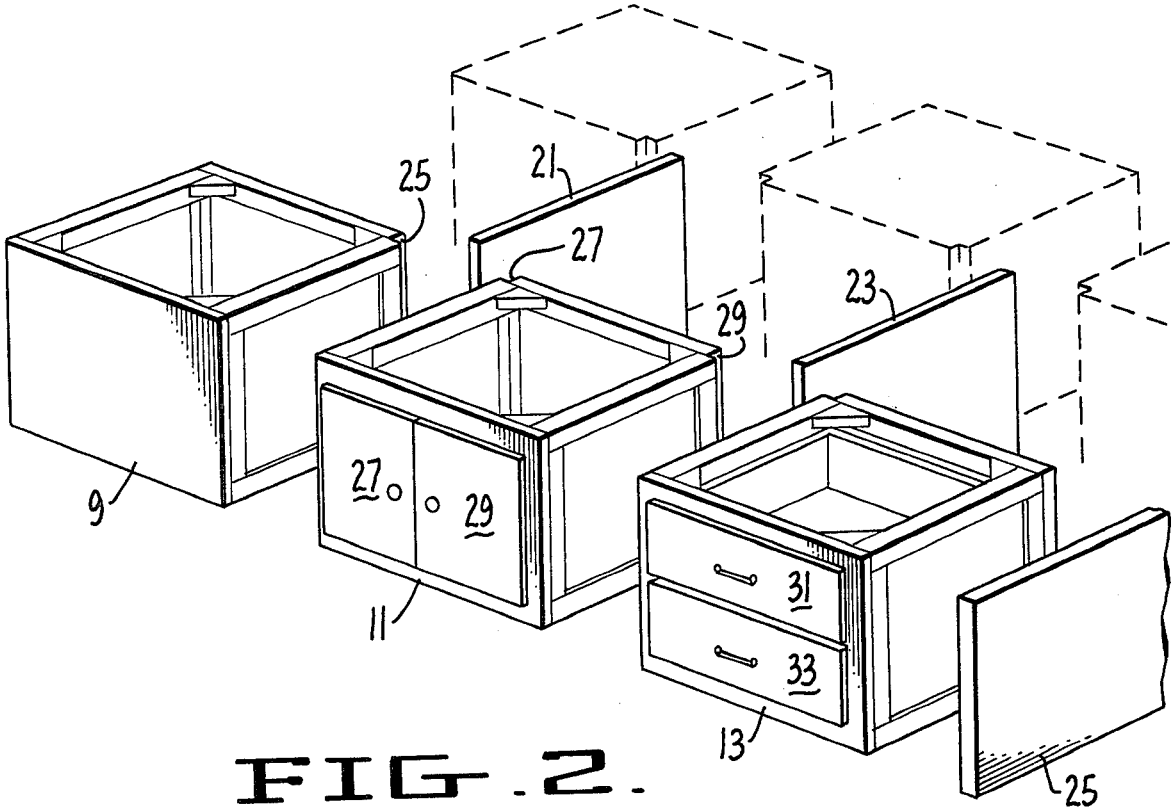
FIG. 2 is an exploded view of some of the waterbed support modules shown in FIG. 1.

The base member designated 5 is employed to support a waterbed 7. The base 5 is made essentially from six modules designated 9, 11, 13, 15, 17 and 19. Each of the modules is notched so that a cross member can be gripped between each of the modules to form the width necessary for a waterbed. These cross members can be made of plywood and are designated 21 and 23. Module 9 has a notch 25 formed in a corner thereof, while the module 11 has two notches 27 and 29 to receive the cross members. A footboard 25 is employed and this can be screwed to the modules 13 and 19. The footboard is for decorative purposes and provides an attractive appearance for the finished assembly.

As was previously mentioned, the modules can be in different forms depending on the use to which the user plans to utilize the support member. For illustrative purposes, the modules 9, 11 and 13 will be described. Module 9 has a plain face as would often be desired at the head of a bed since a night stand frequently occupies this space and it is impractical to utilize the space under the bed for storage. Module 11 has doors 27 and 29 and the module may or may not be equipped with shelves inside but, in any event, the doors permit one to utilize the space within the module for storage purposes. Similarly, module 13 has drawers 31 and 33.

Figure 3:
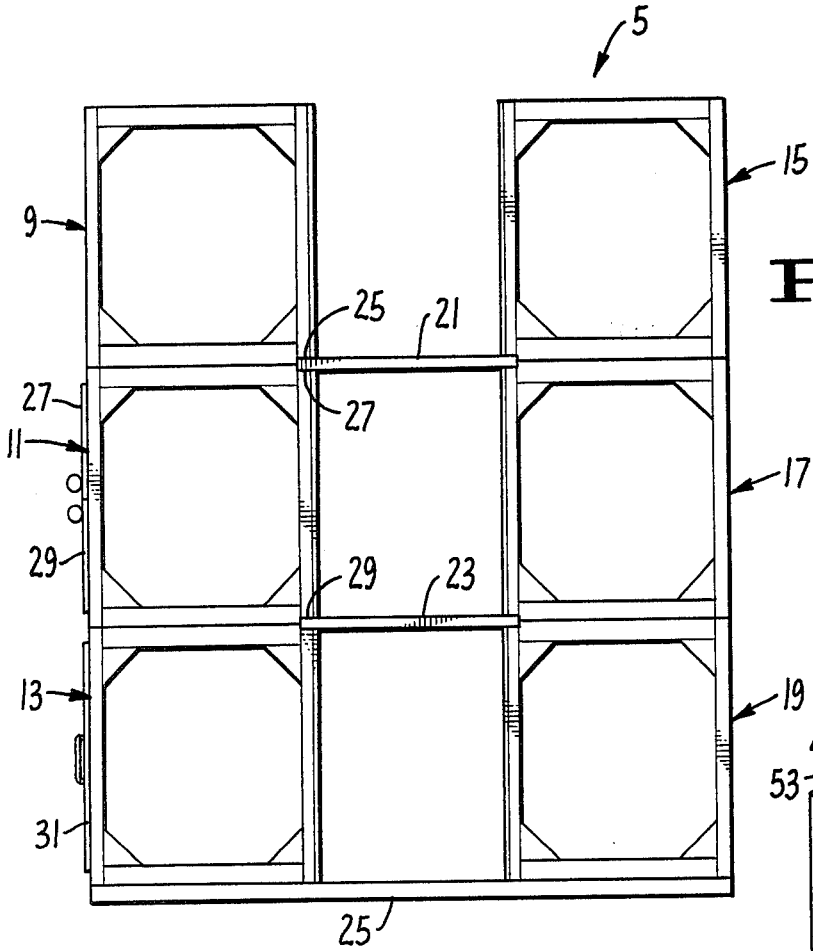
FIG. 3 is a plan view of the support modules showing the parts in place before the installation of a waterbed.
Figure 6:
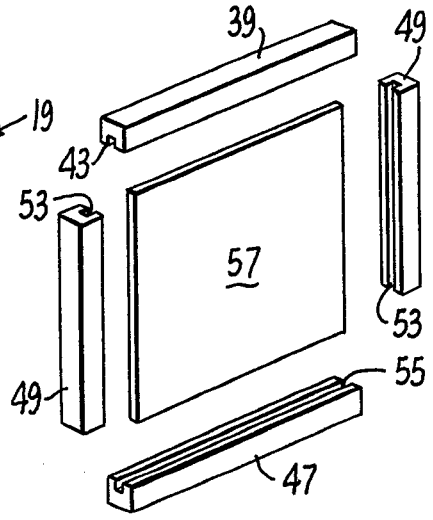
FIG. 6 is an exploded view illustrating a construction method typically used in fabricating the support modules.
Figure 4:
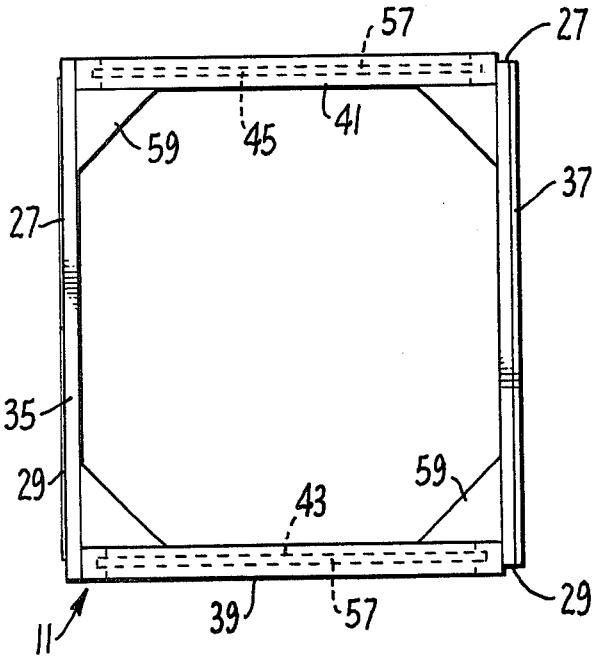
FIG. 4 is a plan view of one of the modules.
Figure 5:
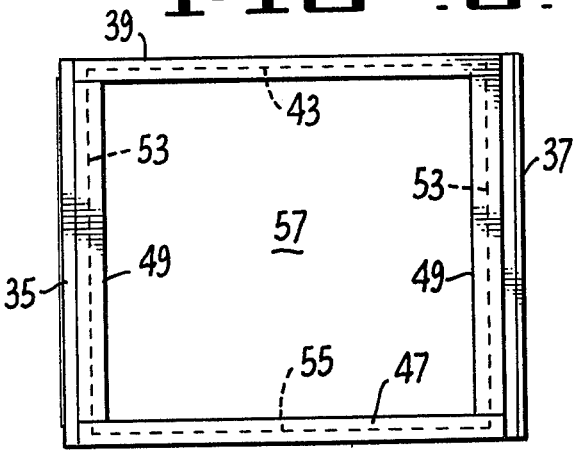
FIG. 5 is a side elevation of one of the modules.

The detailed construction of a typical module is shown in FIGS. 5 and 6. For purposes of illustration, module 11 is described in detail. The module has top frame members 39 and 41 and a plywood back 37 and a front face 35 having the doors 26 and 28 thereon. At the four corners are the uprights 49. Dadoes 43 and 45 are formed in the top frame members 39 and 41 and dadoes 53 are formed in the uprights 49. The bottom frame member designated 47 has a corresponding dado 55. The sides 57 fit in these dadoes as shown and because of the dado construction, it is possible to use quarter-inch plywood despite the fact that the weight supported by the waterbed is great. For added strength, the top and bottom can have corner blocks 59 glued into place. It will be seen that the back 37 has two notches, namely 27 and 29 formed therein, as previously shown in FIG. 3 for reception of the cross plywood members 21 and 23. Of course, if a front module or a back module had been described, only a single notch would be employed and it is only the center module which has the double notches.

The structure thus far described is a preferred embodiment of the invention wherein three modules are used on each side of the waterbed with a space approximately equal to the distance between the modules between the two rows. It is also possible to employ only two modules on each side by making the modules more elongated. Of course, if two modules are employed, it is not necessary to have the double notch structure shown in module 11 and only a single notch need be used in each of the modules as is shown in modules 9 and 13.

It is believed apparent from the foregoing that I have provided a light-weight, simple and inexpensive support for a waterbed and one which can easily be handled by a single person and which obviates the necessity of using a large single frame to support the waterbed.

Although this invention was primarily designed for use as a support for a waterbed, it will be apparent that the invention is one of wide utility and can be used for other purposes such as the support for an ordinary bed.

I claim:

1. A modular support for a waterbed or the like comprising in combination:

a. six modules of generally cubical construction arranged in two rows and having front faces defining the sides of the waterbed;

b. an essentially hollow center space between the two rows of modules at the center of the bed;

c. notches at all interior corners of abutting modules;

d. two boards extending from the modules on one side of the waterbed to the modules on the opposite side of the waterbed and being engaged by said notches.

2. The structure of claim 1 wherein at least one of the modules has doors therein which permit the space under the waterbed to be used for storage.

3. The structure of claim 1 wherein at least one of the modules has a plain face.

4. The structure of claim 1 wherein at least one of the modules has drawers therein for storage purposes.

5. The structure of claim 1 wherein the modules comprise frame members having inwardly-facing dadoes with a sheet of plywood fitting into said dadoes and forming the side members of the module.

* * * * *